US008261806B2

(12) United States Patent
Wettern

(10) Patent No.: US 8,261,806 B2
(45) Date of Patent: Sep. 11, 2012

(54) CONTROL BARRIER FOR PEOPLE

(76) Inventor: Laurence Patrick Wettern, Bridport (GB)

( * ) Notice: Subject to any disclaimer, the term of this patent is extended or adjusted under 35 U.S.C. 154(b) by 109 days.

(21) Appl. No.: 12/668,382

(22) PCT Filed: Jul. 11, 2008

(86) PCT No.: PCT/GB2008/050560

§ 371 (c)(1),
(2), (4) Date: Jan. 8, 2010

(87) PCT Pub. No.: WO2009/007756

PCT Pub. Date: Jan. 15, 2009

(65) Prior Publication Data

US 2010/0181544 A1 Jul. 22, 2010

(30) Foreign Application Priority Data

Jul. 12, 2007 (GB) ..... 0713536.1

(51) Int. Cl.
*A47H 1/00* (2006.01)

(52) U.S. Cl. ..... 160/24; 160/314

(58) Field of Classification Search ..... 160/24, 160/314, 315, 313, 306; 256/1, 24
See application file for complete search history.

(56) References Cited

U.S. PATENT DOCUMENTS

| | | | | |
|---|---|---|---|---|
| 4,844,420 | A * | 7/1989 | Oster | 256/1 |
| 5,464,052 | A * | 11/1995 | Wieczorek et al. | 160/23.1 |
| 5,813,449 | A * | 9/1998 | Patmore et al. | 160/370.22 |
| 5,934,354 | A * | 8/1999 | Price et al. | 160/370.22 |
| 6,375,164 | B1 * | 4/2002 | Siegler et al. | 256/1 |
| 6,536,502 | B2 * | 3/2003 | Britto et al. | 160/23.1 |
| 6,595,496 | B1 * | 7/2003 | Langlie et al. | 256/1 |
| 6,776,398 | B1 * | 8/2004 | Tsai | 256/45 |
| 6,807,999 | B1 * | 10/2004 | Bowen et al. | 160/24 |
| 7,178,790 | B2 * | 2/2007 | de Lorenzo | 256/59 |
| 7,350,480 | B1 * | 4/2008 | Hughes | 119/512 |
| 2002/0063248 | A1 * | 5/2002 | Siegler et al. | 256/37 |
| 2005/0191107 | A1 * | 9/2005 | Christie | 400/208 |

* cited by examiner

*Primary Examiner* — David Purol
(74) *Attorney, Agent, or Firm* — Andrus, Sceales, Starke & Sawall, LLP

(57) ABSTRACT

A barrier for the control of people has a stand (10,11) supporting a housing (12) for a flexible band (14) extensible from the housing through a slot (15) in the side wall thereof. The spool and band are removable through the open upper end of the housing (12) and a tensioning cassette (16) for the spool is engaged with the housing and is drivingly coupled to the spool (13). A spring tensioner (29) acts between an outer wall (26) of the cassette and a drive shaft (30) for the spool. Tension may be applied to the spring (29) by freeing the cassette (16) from the housing (10) while leaving the drive shaft (30) connected to the spool (13) and then rotating the cassette, relative to the housing.

17 Claims, 4 Drawing Sheets

CONTROL BARRIER FOR PEOPLE

CROSS REFERENCE TO RELATED APPLICATION

The present application is the U.S. national stage application of International Application PCT/GB2008/050560, filed Jul. 11, 2008, which international application was published on Jan. 15, 2009 as International Publication WO 2009/007756 A1. The International Application claims priority of British Patent Application 07 13536.1, filed Jul. 12, 2007.

This invention relates to a barrier for the control of movement of people, which barrier is of the kind having a flexible band extensible from a housing provided on a stand, to control the movement of people for example in a queue.

People control barriers of the kind described above are widely used in many circumstances where many people are likely to gather. For example, barriers of the kind described may be used in airports, banks, at stadia and particularly at places where people may have to queue and there is a requirement to ensure the queue moves in an orderly and proper manner. A typical barrier has a spool around which the flexible band—often of webbing or a similar material such as a plastic strip—is wound, the spool being spring-loaded so that the band is extended out of the housing against the spring loading but on releasing the band from some other remote support, the band is automatically rewound on to the spool, in the housing.

Not infrequently, the flexible band extensible from the housing becomes damaged, either accidentally or deliberately. When this occurs, the band must be replaced but this requires dismantling of the assembly, replacement of the band on a carrier provided within the housing and then re-tensioning of the spring to ensure that the band will wind up into the housing when the free end is released from a remote support. Most often, various hand tools are required for this and in view of the risk associated with the tensioning of the spring, training must be given to the persons intending to effect the change, which usually means that the replacement of the band must be performed by the service department of an organisation, rather than by the general staff.

In addition, it is quite common to have some printing on the band, either in the form of instructions to people being guided by the barrier or in the nature of an advertisement. Should it be needed to replace the instructions by others, or should it be required to display a different advertisement, dismantling of the assembly as described above is needed, in order that a different band may be secured to the spool and then be wound therearound into the housing, ready for use.

It is a principal aim of the present invention to provide a barrier of the kind described, wherein it is a relatively simple matter to change the flexible band extensible from the housing, and which may be performed by relatively unskilled persons, with minimal risk to health and safety.

According to this invention, there is provided a barrier for the control of people comprising a stand supporting a housing for a flexible band extensible from the housing through a slot in the side wall thereof, the upper end of the housing being open, a spool carrying a band rotatably received in the housing with the band emerging through the slot, the spool and band being removable through the open upper end of the housing, and a tensioning cassette for the spool, said cassette having an outer wall releasably engageable with the upper end of the housing, a drive member engageable with the spool and rotatable with respect to the outer wall, and a spring tensioner acting between the outer wall and rotatable member and which may be charged by relative rotation between outer wall and the drive member, the arrangement being such that the drive member is engageable with the spool while the outer wall remains free of the housing so that rotation of the outer wall tensions the spring means whereafter the outer wall of the cassette is engageable with the housing.

With the barrier of this invention, it becomes a relatively simple matter to change the flexible band loaded into the housing with another, either because the band has become damaged and must be changed for a new one, or because it is required to display a message or advertising not carried by the existing band. This is achieved by releasing the cassette from the housing and allowing the tension of the spring tensioner to release by letting the cassette unwind relative to the spool, whereafter the spool together with its band may be lifted out of the housing. Then, a spool having the required band already wound therearound may be lowered into the housing with the band passing through the slot and the free end of the band remaining outside the housing. The drive member of the cassette is then engaged with the spool and the cassette is rotated relative to the spool and housing in order to pre-load the spring tensioner, whereafter the cassette is engaged with the housing, so completing the replacement of the band. No special tools nor training are required for this.

In order to facilitate the accommodation of the replacement band in the slot in the housing, as well as the removal of an existing band from that slot, it is highly preferred that the slot opens into the open end of the housing. In this way, a short length of the band may be extended from the spool during the replacement operation and when the spool is lowered into the housing, simultaneously that short length may be lowered into the slot. The free end of the band may be used to hold the spool against rotation, as the spring tensioner is tensioned.

With a barrier of the kind described, the free end of the band is normally provided with some kind of hook arrangement, to allow it to be connected to some other component, remote from the stand carrying the housing. Typically, there may be an elongate member attached to and extending transversely of the band at the free end, that elongate member having a greater cross-section that the width of the slot. Thus, the elongate member will prevent the band winding fully on to the spool when the member is released from another component and also the member assists the extending of the band away from the housing. The barrier of this invention preferably also has such an elongate member for the same purposes as with the known form of barrier; but that elongate member will also perform the function of holding the spool against rotation as the spring tensioner is tensioned by turning the cassette.

The connection between the drive member and the spool must be such that the cassette may remain free of the housing to allow the relative rotation of the cassette while the drive member is connected to the spool. This may be achieved by having a drive member of sufficient length and with a sliding connection between the drive member and spool, so that the outer wall of the cassette remains free of the housing during tensioning but when tensioned, the cassette may be interengaged with the housing. Another possibility would be to hold the upper end of the spool above the lower end of the housing, connecting the drive member of the cassette to the spool and then rotating the cassette to tension the spring tensioner. When there is sufficient tension, the cassette may be pushed down to interengage the housing, the spool moving fully into the housing during this action.

A bearing for the lower end of the spool may be provided in order to facilitate the rotation thereof. In such a case, that bearing may permit significant axial movement of the spool while the spool remains engaged with the bearing, to facilitate the tensioning action described immediately hereinbefore, with the upper end of the spool held above the upper end of the housing. Alternatively, or perhaps in addition, a tapered entry may be provided for the lower end of the spool, to assist engagement of the spool with the bearing. For example, the spool may have a shaft projecting from its lower end which shaft has a tapered end portion, facilitating entry of the shaft into the bearing.

Preferably, a cap is provided for the cassette, which cap is releasably attachable to the cassette when the cassette has been fitted to the housing. Advantageously, the cap serves to lock the connection between the cassette and the housing so as to prevent removal of the cassette therefrom until the cap has been removed from the cassette. For example, the cap may have an encircling wall for the cassette, that encircling wall being provided with internal fingers which act between the housing and the cassette, thereby to lock the cassette against releasing movement, relative to the housing.

A security lock may be provided for the cap, to resist unauthorised removal of the cap from the cassette. Such a lock may comprise a cam rotatably mounted internally of the cap and which may be rotated to become received in a slot provided within the cassette. A turning element for the cam may be profiled for operation by an appropriately formed tool or may have a key-lock mechanism permitting operation only by an appropriate key.

In a preferred embodiment, the spring tensioner comprises a spirally-wound strip of spring material such as spring steel and so which resembles a clock spring. The inner end of the spirally-wound strip should be connected to the drive member and the outer end to the outer wall of the cassette. For safety reasons, such a spring tensioner should be contained in a substantially closed chamber, provided within the cassette.

By way of example only, one specific embodiment of barrier of this invention for the control of people will now be described in detail, reference being made to the accompanying drawings in which:—

FIG. 1 diagrammatically represents two stands each having a housing containing a flexible band extensible from the housing and arranged in accordance with this invention;

Figure 1:
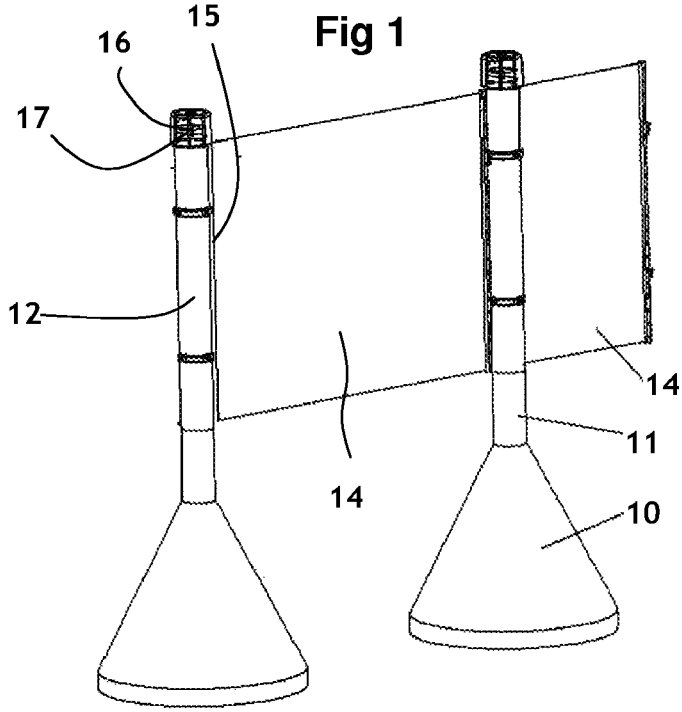
Figure 2:
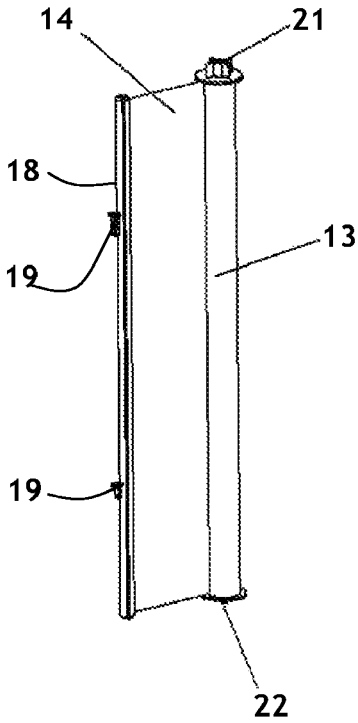
FIG. 2 shows a spool used within the housing and having a flexible band wound therearound.
Figure 3:
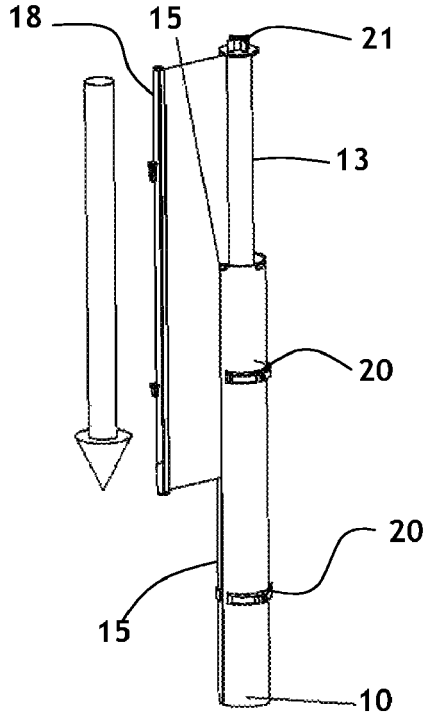
FIG. 3 illustrates the insertion of a spool and band into a housing.

A control barrier of this invention comprises a relatively massive base 10 supporting an upstanding post 11 having a cylindrical housing 12 at its upper end. The housing contains a spool 13 (FIG. 3) around which a flexible band 14 is wound, the band emerging from the housing through an axial slot 15. Fitted to the upper end of the housing is a tensioning cassette 16 having a cap 17. The transverse free edge of the band 14 is secured to a bar 18 externally of the housing, that bar having a pair of spaced hooks 19 to allow connection of the bar to the housing of a second, like barrier, as shown in FIG. 1. For this purpose, each housing 10 is provided with spaced receptors 20 for the hooks 19 of a band extended from the housing of another barrier.

Figure 4:
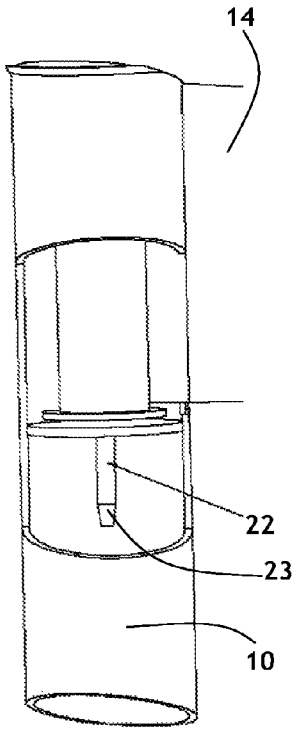
FIG. 4 illustrates one possibility for the lower end of the spool, as being fitted into the housing shown partially cut away.
Figure 5:
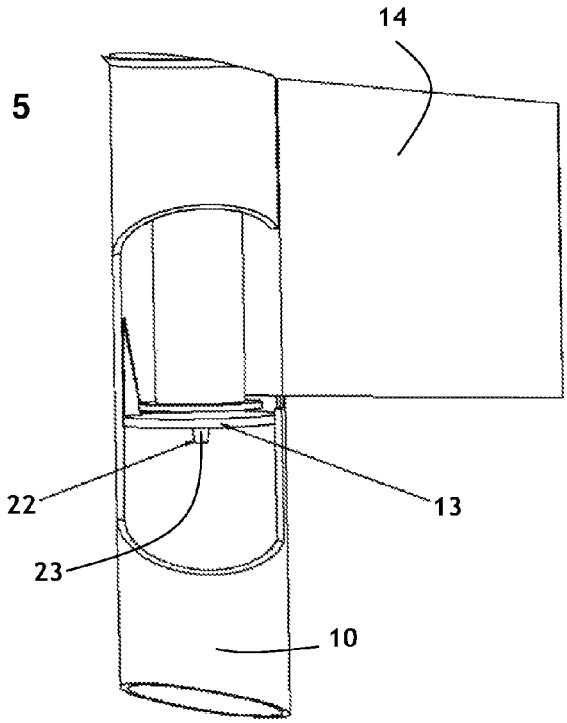
FIG. 5 is similar to FIG. 4 but shows a modified form of the lower end of the spool.

The spool 13 has an upper end portion 21 of cruciform cross-sectional shape and having a bore with at least one inwardly-directed spline or key. The lower end portion of the spool is formed with a shaft 22 the free end portion 23 of which may be tapered as shown in FIG. 4, to facilitate the interengagement of the shaft with a bearing provided centrally within the lower end of the housing. The shaft of FIG. 4 is relatively long such that axial movement of the spool may take place while the shaft remains engaged with the bearing. By contrast, the shaft shown in FIG. 5 is relatively short. Between the end portions, the spool is formed to allow the connection thereto of the inner end of the band 14, to be wound therearound.

Figure 6:
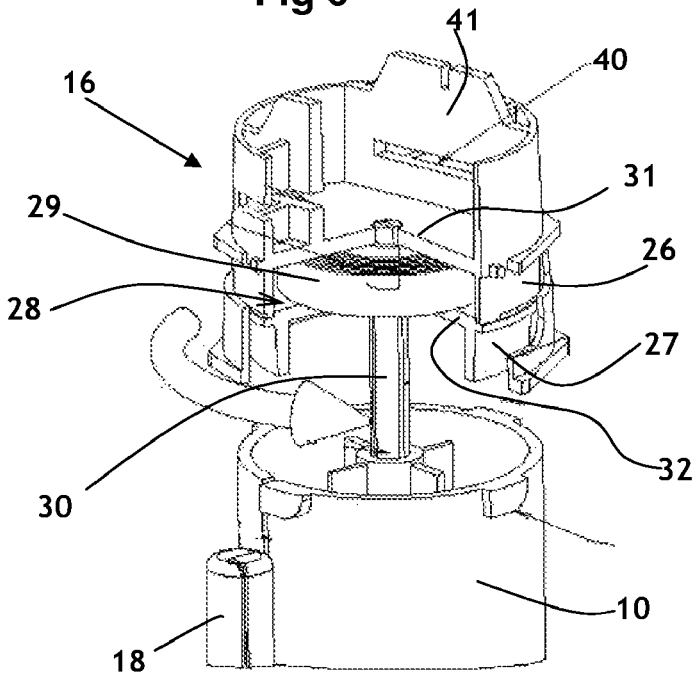
FIG. 6 is a quarter-sectional view through a cassette and showing the upper end of the housing.
Figure 7:
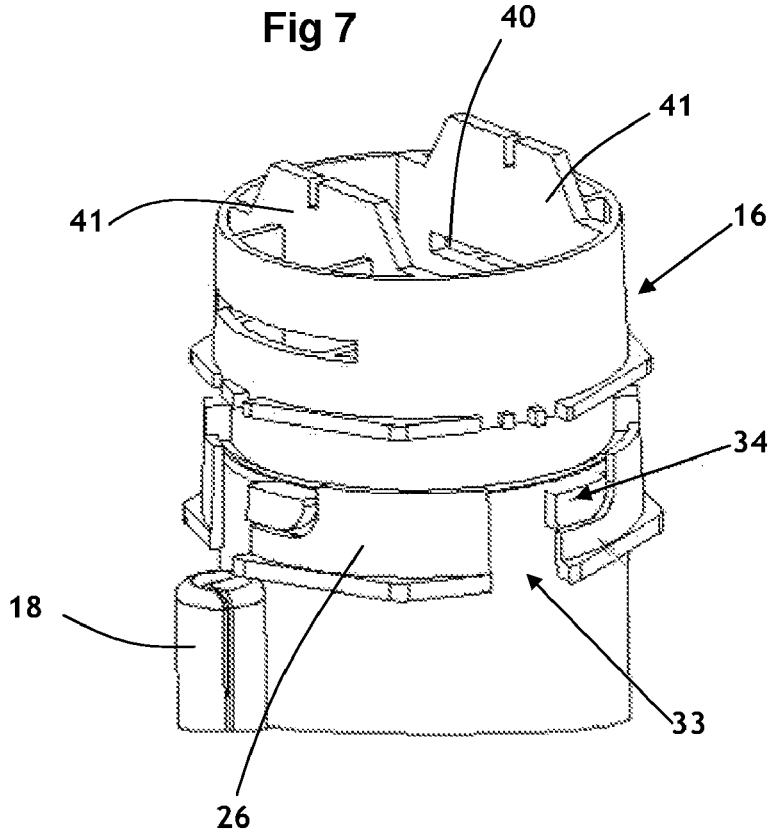
FIG. 7 shows the cassette connected to the housing.

FIGS. 6 and 7 show the tensioning cassette 16 for use with the assembly of spool and housing, described above. This tensioning cassette has an outer cylindrical wall 26 and a concentric an inner cylindrical wall 27. A chamber 28 is defined within the outer wall 26 and accommodates a spirally-wound flat metal spring 29 formed from spring steel strip. A drive shaft 30 is journalled in radial walls 31,32, respectively associated with the outer and inner cylindrical walls 26,27 and has at least one keyway to accommodate the at least one spline or key provided within the bore of the upper end portion 21 of the spool. In this way, and as shown in FIG. 6, the drive shaft 30 may slide axially with respect to the spool 13 but is held against rotation relative thereto.

A bayonet-type connection is provided between the upper end of the housing 12 and the outer cylindrical wall 26 of the cassette 16. Four equi-spaced L-shaped slots 33 are formed in the outer cylindrical wall 26, lugs 34 formed on the external wall of the housing at the upper end thereof being engageable with those slots 33 by initial axial movement of the cassette relative to the housing, followed by rotational movement of the cassette. The inner cylindrical wall 27 is a close fit within the housing 12, such that the upper end of the housing is held between the outer and inner cylindrical walls 26,27, so as to maintain the slot 15 at the required width.

Figure 8:
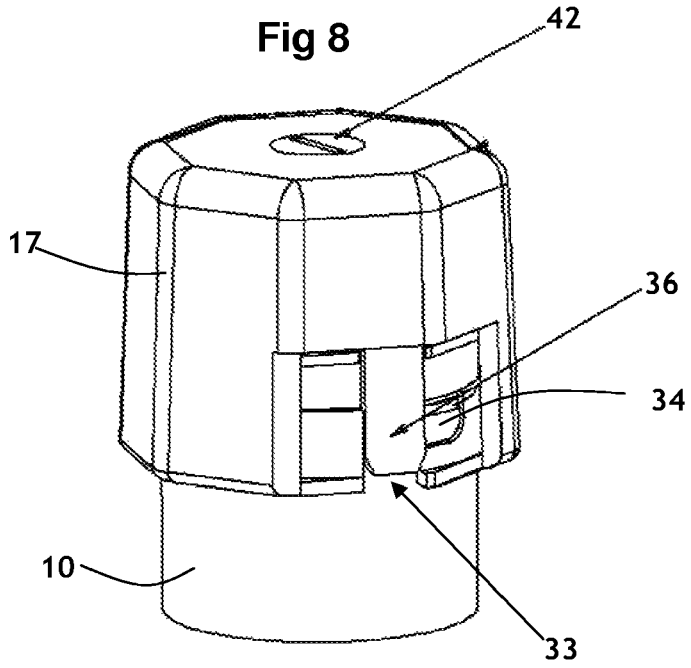
FIG. 8 shows a cap, partially cut away, for the cassette and fitted thereto.
Figure 9:
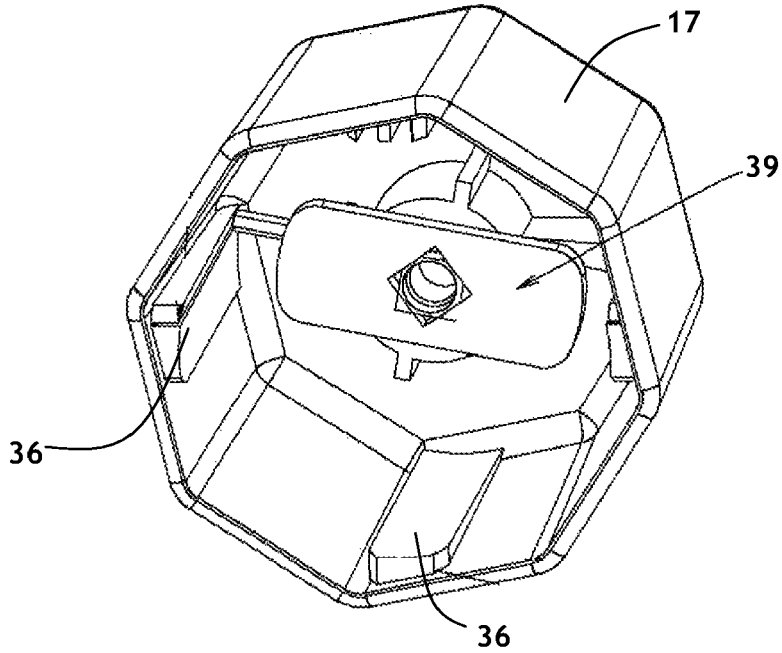
FIG. 9 is an isometric view of the interior of the cap.

The cap 17 is shown in FIGS. 8 and 9 and has an octagonal cross-sectional shape, the side walls of that cap being provided with four fingers 36 extending parallel to the cap axis. When the cap 17 is fitted to the cassette 16, those fingers block the L-shaped slots 33 thereby preventing the lugs 34 moving out of the slots and so maintaining the cassette 16 engaged with the housing 12. Rotatably mounted in a boss 37 formed internally of the end wall 38 of the cap is a double-armed cam 39, engageable in slots 40 formed in walls 41 at the upper end of the cassette, within the outer cylindrical wall 26. The cam may be rotated by means of a screw-head 42 accessible from outside the cap but this screw-head may be replaced by some other higher security formation or even by a key-lock assembly, so as to resist removal of the cap other than by authorised people having the appropriate tool or key.

When a barrier band 14 is to be replaced, either because an existing band has been damaged or to change a message carried by the band, the band is allowed to wind around the spool until bar 18 engages the outside of the housing. The cap 17 is removed by turning the cam 39, whereafter the cassette may be turned and lifted to come clear of the housing while the drive shaft 30 still remains connected to the spool. The cassette is allowed to unwind the spring 29 by lightly holding the cassette and then the cassette is lifted away from the spool whereafter the spool and band may be removed from the housing.

Reassembly is performed by lowering a spool with a band wound therearound into the housing, with the replacement band extending through the slot 15 and the bar 18 of that band remaining external of the housing. In the case of the relatively short shaft 22 of FIG. 5, the spool is lowered fully into the housing to engage that shaft with the bearing at the bottom of the housing, but in the case of the relatively long shaft 22 of FIG. 4, the spool may be held with the lower end thereof raised from the lower end of the housing.

The drive shaft 30 of the cassette 16 is engaged with the spool while the cassette remains free of the housing. In the case of the relatively short shaft 22 of FIG. 5, for this purpose the drive shaft 30 must be relatively long but in the case of the relatively long shaft 22 of FIG. 4, the drive shaft 30 may be much shorter so long as the spool is held with its upper end above the upper end of the housing. Either way, once the drive shaft is engaged with the spool, the cassette is rotated to tension the spring 29 before the cassette is pressed down to engage the housing and interconnect the lugs 34 with the L-shaped slots 33. Finally, cap 17 is fitted to the cassette 16 and is locked in place by turning the cam 39.

The invention claimed is:

1. A barrier for the control of people comprising:

a stand;

a housing for a flexible band extensible therefrom, said the housing being supported by the stand and having a side wall, an open upper end and a slot in the side wall;

a spool rotatably received in the housing and carrying a flexible band extensible from the housing through said slot, the spool and band being removable through the open upper end of the housing; and a tensioning cassette for the spool, said cassette having an outer wall, a drive member rotatably mounted within the cassette, and a spring tensioner acting between the outer wall and the drive member and arranged to be charged by relative rotation between the outer wall and the drive member, the cassette being provided as a unit engageable with and removable from said open upper end of the housing, and the arrangement of the housing and cassette being such that on fitting the cassette to the housing, the drive member is engageable with the spool while the outer wall of the cassette remains free of the housing so that rotation of the outer wall tensions the spring tensioner, whereafter the outer wall of the cassette is engaged with the housing.

2. A barrier as claimed in claim 1, wherein the slot in the side wall of the housing opens into the open upper end of the housing whereby the band may be lowered into the slot as the spool is lowered into the housing.

3. A barrier as claimed in claim 1, wherein the drive member has a sufficient length to allow connection with the spool while the outer wall of the cassette remains free of the housing.

4. A barrier as claimed in claim 1, wherein the housing has a lower end provided with a bearing for the lower end of the spool.

5. A barrier as claimed in claim 4, wherein said bearing permits relative axial movement between the spool and the housing when the spool is engaged therewith so that the lower end of the spool remains engaged with the bearing when not in its a fully-lowered position.

6. A barrier as claimed in claim 4, wherein a tapered entry is provided for the lower end of the spool to engage with the bearing.

7. A barrier as claimed in claim 1, wherein there is one of a bayonet connection and screw-threaded connection provided between the cassette and the housing.

8. A barrier as claimed in claim 7, wherein a cap is provided for the cassette, the cap being releasably connectable to the cassette once fitted to the housing.

9. A barrier as claimed in claim 8, wherein the cap when fitted to the cassette serves to lock the connection between the cassette and the housing to prevent removal of the cassette from the housing until the cap has been removed from the cassette.

10. A barrier as claimed in claim 9, wherein the cap includes an encircling wall for the cassette, the internal surface of said wall being provided with fingers which act between the housing and the cassette to lock the housing and the cassette against relative releasing movement.

11. A barrier as claimed in claim 9, wherein a security lock is provided for the cap to resist unauthorised removal of the cap from the cassette.

12. A barrier as claimed in claim 11, wherein the security lock comprises a cam rotatably mounted internally of the cap and receivable in a slot in the cassette, the cam having a turning element operable by an appropriately formed tool or key.

13. A barrier as claimed in claim 1, wherein the spring tensioner comprises a spirally-wound strip of spring-material having inner and outer ends, the inner end being connected to the drive member and the outer end being connected to the outer wall of the cassette.

14. A barrier as claimed in claim 13, wherein the spring tensioner is contained in a substantially closed chamber provided within the cassette.

15. A barrier as claimed in claim 1, wherein one end of the flexible band is secured to the spool and the other end is attached to an elongate member extending transversely to the length of the band and of a greater cross-section than the width of the slot in the housing.

16. A barrier as claimed in claim 15, wherein the elongate member is provided with at least one hook for engagement with a receptor provided on the housing of another like stand.

17. A barrier for the control of people comprising:

a stand;

a housing for a flexible band extensible therefrom, said housing being supported by the stand and having a side wall, an open upper end and a slot in the side wall;

a spool rotatably received in the housing and carrying a flexible band extensible from the housing through said slot, the spool and band being removable through the open upper end of the housing; and a tensioning cassette for the spool, said cassette having:

an outer wall releasably engageable with the open upper end of the housing by means of one of a bayonet connection and screw-threaded connection;

a cap releasably connectable to the cassette once the cassette has been connected to the housing, said cap when fitted to the cassette serving to lock the connection between the cassette and the housing to prevent removal of the cassette from the housing until the cap has been removed from the cassette;

a security lock for the cap, to resist unauthorised removal of the cap from the cassette, said security lock comprising a cam rotatably mounted internally of the cap and receivable in a slot in the cassette, the cam having a turning element operable by an appropriately formed tool or key;

a drive member rotatably mounted in the cassette and engageable with the spool, the drive member being rotatable with respect to the outer wall; and a spring tensioner acting between the outer wall and the drive member and arranged to be charged by relative rotation between the outer wall and the drive member, the arrangement being such that the drive member is engageable with the spool while the cassette outer wall remains free of the housing so on connecting the cassette to the housing, rotation of the outer wall tensions the spring tensioner whereafter the outer wall cassette is engaged with the housing.

* * * * *